US008091714B2

(12) United States Patent
Arradondo et al.

(10) Patent No.: US 8,091,714 B2
(45) Date of Patent: Jan. 10, 2012

(54) METHOD FOR DISPLAYING MERCHANDISE IN FRONT OF BACKER MATERIAL

(75) Inventors: Christine Arradondo, St. Louis Park, MN (US); Jeremy A. Clark, Minneapolis, MN (US); Joseph J. Hines, Rogers, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/087,489

(22) Filed: Apr. 15, 2011

(65) Prior Publication Data

US 2011/0185558 A1 Aug. 4, 2011

Related U.S. Application Data

(62) Division of application No. 11/734,205, filed on Apr. 11, 2007, now Pat. No. 7,950,536.

(51) Int. Cl.
*A47F 5/08* (2006.01)

(52) U.S. Cl. ..... 211/103; 248/220.21

(58) Field of Classification Search ..... 211/87.01, 211/90.02, 94.01, 103, 187, 190, 191, 207, 211/123, 204, 206; 160/351, 330, 349.1; 108/108, 106, 107, 109, 110; 52/36.4–36.6, 52/481.2, 506.06; 248/220.21, 220.31, 220.41, 248/225.21, 351, 682; 410/89
See application file for complete search history.

(56) References Cited

U.S. PATENT DOCUMENTS

| | | | |
|---|---|---|---|
| 200,767 | A | 2/1878 | Sanderson |
| 421,383 | A | 2/1890 | Carey, Jr. et al. |
| 454,005 | A | 6/1891 | Parsons et al. |
| 563,299 | A | 7/1896 | Nitzsche |
| 891,228 | A | 6/1908 | Bowen |
| 1,037,487 | A | 9/1912 | Jones |
| 1,674,619 | A | 6/1928 | Dover |
| 1,862,971 | A | 6/1932 | Lovrich |
| 1,881,736 | A | 10/1932 | Lichter |
| 1,892,794 | A | 1/1933 | Wertzler |
| 2,074,928 | A | 3/1937 | Miller |
| 2,245,705 | A | 6/1941 | Norris |
| 2,283,205 | A | 5/1942 | Harris |
| 2,357,819 | A | 9/1944 | Greer |

(Continued)

OTHER PUBLICATIONS

Target Corporation, "Hosiery-Assets Shapewear Header Instructions," 4 pp., provides a description of methods and apparatuses known, used, or sold prior to Apr. 11, 2007.

(Continued)

*Primary Examiner* — Darnell Jayne
*Assistant Examiner* — Joshua Rodden
(74) *Attorney, Agent, or Firm* — Nixon & Vanderhye P.C.

(57) ABSTRACT

A top hardware bar includes a body, a first bracket, and a second bracket. The body is elongate and defines a first end, a second, opposite end, a channel, and a plurality of holes disposed lengthwise along the body. The first bracket is secured to the first end of the body and is releasably secured to a first upright. The second bracket is adjustably secured within the channel at the second end of the body and is releasably secured to a second upright. A backer piece is secured to the body of the top hardware bar along a top portion of the backer piece such that the backer piece hangs from the top hardware bar. A product fixture is then placed in front of the backer piece to support products, with the ends of the product fixture being attached to the first and second uprights, respectively.

16 Claims, 9 Drawing Sheets

U.S. PATENT DOCUMENTS

| | | | | |
|---|---|---|---|---|
| 2,544,950 | A | | 3/1951 | Davidson, Sr. |
| 2,571,382 | A | | 10/1951 | Raven |
| 2,588,641 | A | | 3/1952 | Lundstrom |
| 2,643,846 | A | | 6/1953 | Lundstrom |
| 2,796,158 | A | | 6/1957 | Miles et al. |
| 2,798,545 | A | | 7/1957 | Busciolano |
| 2,867,918 | A | | 1/1959 | Miller |
| 2,876,909 | A | | 3/1959 | Sharp |
| 2,910,121 | A | | 10/1959 | Stern et al. |
| 2,930,638 | A | | 3/1960 | Morrissey |
| 2,971,805 | A | | 2/1961 | Weiss |
| 2,991,889 | A | | 7/1961 | Levy et al. |
| 3,159,437 | A | | 12/1964 | Jentzen |
| 3,244,127 | A | | 4/1966 | Evans |
| 3,290,846 | A | | 12/1966 | Mader et al. |
| 3,471,978 | A | | 10/1969 | Fenwick |
| 3,490,604 | A | | 1/1970 | Klein |
| 3,494,405 | A | | 2/1970 | Sandahl et al. |
| 3,495,717 | A | | 2/1970 | Lavin et al. |
| 3,517,623 | A | | 6/1970 | Goldstein et al. |
| 3,565,152 | A | | 2/1971 | Cohn, Jr. et al. |
| 3,583,466 | A | | 6/1971 | Dreyer |
| 3,640,389 | A | | 2/1972 | Snyder |
| 3,730,108 | A | | 5/1973 | Stroh |
| 3,779,394 | A | | 12/1973 | Bard |
| 3,788,378 | A | | 1/1974 | Sobel |
| 3,824,725 | A | | 7/1974 | Friedrichsen |
| 4,085,789 | A | | 4/1978 | Steiner et al. |
| 4,127,196 | A | | 11/1978 | Boucher |
| 4,133,433 | A | | 1/1979 | Wolf |
| RE29,977 | E | | 5/1979 | Lundqvist |
| 4,256,043 | A | | 3/1981 | Ovitz, III |
| 4,312,086 | A | | 1/1982 | Bianco |
| 4,316,547 | A | | 2/1982 | Varon |
| 4,349,113 | A | | 9/1982 | Schreiner |
| 4,356,647 | A | | 11/1982 | Farris |
| 4,415,091 | A | | 11/1983 | Wolff |
| 4,418,882 | A | | 12/1983 | Waring |
| 4,459,773 | A | | 7/1984 | Sandlin et al. |
| 4,585,131 | A | | 4/1986 | Crossman et al. |
| D289,353 | S | | 4/1987 | Davis et al. |
| 4,706,728 | A | | 11/1987 | McKay |
| 4,784,205 | A | | 11/1988 | Johnson et al. |
| 4,899,974 | A | | 2/1990 | Wear et al. |
| 5,096,069 | A | | 3/1992 | Brandon |
| 5,104,269 | A | * | 4/1992 | Hardison ..... 410/149 |
| 5,305,898 | A | | 4/1994 | Merl |
| 5,427,255 | A | | 6/1995 | Nook |
| 5,439,123 | A | | 8/1995 | Nook |
| 5,454,638 | A | | 10/1995 | Bird et al. |
| 5,472,103 | A | | 12/1995 | Merl |
| 5,477,971 | A | | 12/1995 | Howard |
| 5,495,952 | A | | 3/1996 | Kainz |
| 5,509,541 | A | | 4/1996 | Merl |
| 5,611,442 | A | | 3/1997 | Howard |
| 5,624,044 | A | | 4/1997 | Black, Jr. |
| 5,641,081 | A | | 6/1997 | Merl |
| 5,660,637 | A | | 8/1997 | Dodge |
| 5,769,247 | A | | 6/1998 | Merl |
| D400,361 | S | | 11/1998 | Sobrito |
| 5,833,337 | A | | 11/1998 | Kofstad |
| 5,918,750 | A | | 7/1999 | Jackson |
| 5,921,411 | A | | 7/1999 | Merl |
| 5,944,203 | A | | 8/1999 | Vlah et al. |
| 5,988,409 | A | | 11/1999 | Gusdorf et al. |
| 6,023,896 | A | | 2/2000 | Rothschild |
| 6,029,833 | A | | 2/2000 | Yeh |
| 6,044,986 | A | | 4/2000 | Wood |
| 6,062,399 | A | | 5/2000 | Henry et al. |
| 6,193,083 | B1 | | 2/2001 | Wood |
| 6,223,908 | B1 | | 5/2001 | Kurtsman |
| 6,234,328 | B1 | | 5/2001 | Mason |
| 6,349,516 | B1 | | 2/2002 | Powell et al. |
| 6,370,803 | B1 | | 4/2002 | Burquest |
| 6,478,166 | B2 | | 11/2002 | Hung |
| 6,520,355 | B1 | | 2/2003 | Pritchard et al. |
| 6,554,142 | B2 | | 4/2003 | Gray |
| 6,581,787 | B2 | | 6/2003 | Barrett et al. |
| 6,612,077 | B2 | | 9/2003 | Parshad |
| 6,625,935 | B1 | | 9/2003 | King et al. |
| 6,659,295 | B1 | | 12/2003 | De Land et al. |
| D487,354 | S | | 3/2004 | Hahn |
| 6,739,682 | B2 | | 5/2004 | Shih |
| 6,773,080 | B2 | | 8/2004 | Chen et al. |
| D495,501 | S | | 9/2004 | Hahn |
| D495,502 | S | | 9/2004 | Hahn |
| D495,503 | S | | 9/2004 | Hahn |
| D498,063 | S | | 11/2004 | Hahn |
| D499,888 | S | | 12/2004 | Hahn |
| D499,889 | S | | 12/2004 | Hahn |
| D503,045 | S | | 3/2005 | Hahn |
| 6,895,704 | B2 | | 5/2005 | Ives et al. |
| 6,918,499 | B2 | | 7/2005 | De Land et al. |
| 6,974,037 | B2 | | 12/2005 | Haney |
| 6,996,929 | B1 | | 2/2006 | Greene, Jr. et al. |
| 7,100,878 | B2 | | 9/2006 | Shea |
| 7,150,127 | B2 | | 12/2006 | Underwood et al. |
| 7,258,317 | B1 | | 8/2007 | Nagel |
| 7,448,634 | B1 | | 11/2008 | Raub |
| D591,531 | S | | 5/2009 | Sparkowski |
| 2004/0007550 | A1 | | 1/2004 | Leeman et al. |
| 2004/0098895 | A1 | | 5/2004 | Sparkowski |
| 2006/0021269 | A1 | | 2/2006 | Doctoroff |
| 2008/0078728 | A1 | | 4/2008 | Hodge |

OTHER PUBLICATIONS

Target Corporation, "Backer Paper In-Store Marketing Signing Instructions," 1 pg., provides a description of methods and apparatuses known, used, or sold prior to Apr. 11, 2007.

Target Corporation, "Hosiery Bar Drawing," 1 pg., provides a description of methods and apparatuses known, used, or sold prior to Apr. 11, 2007.

* cited by examiner

METHOD FOR DISPLAYING MERCHANDISE IN FRONT OF BACKER MATERIAL

This application is a divisional of U.S. patent application Ser. No. 11/734,205, filed Apr. 11, 2007 now U.S. Pat. No. 7,950,536, the entire content of which is hereby incorporated by reference in this application.

BACKGROUND

Various types of displays are used to support and present merchandise to consumers in a retail environment. Displays that are eye-catching, fun, interesting, or otherwise visually effective help promote retail sales. Additionally, displays that are able to be efficiently set up, broken down, and adaptable for use with different base fixtures or mounts are preferred. Such displays provide more efficient use of resources, including better use of employee time and reduced costs via cross-compatibility. As such, it is desirable to provide display systems characterized as visually pleasing, adaptable, and readily assembled. While traditional displays accomplish these features to some extent, enhancements in the functionality, or overall merchandising effectiveness, of such displays remain to be realized.

SUMMARY

Some aspects relate to a display system including first and second uprights, a top hardware bar, and a backer piece. The first upright is secured in a substantially vertical orientation. The first upright is substantially elongate and has a plurality of slots. The second upright is secured in an adjacent position to the first upright and in a substantially vertical orientation. The second upright is also elongate and has a second plurality of slots. The top hardware bar includes a body, a first bracket, and a second bracket. The body is substantially elongate and defines a first end, a second end opposite the first end, a channel, and a plurality of holes disposed lengthwise along the body. The first bracket is secured to the first end of the body and is adapted to be releasably secured to the first upright. The second bracket is adjustably secured within the channel at the second end of the body and is adapted to be releasably secured to the second upright. The backer piece is formed of sheet material and has a top portion and a bottom portion. In particular, the backer piece is secured to the body of the top hardware bar along the top portion of the backer piece such that the backer piece hangs from the top hardware bar.

Various other aspects are contemplated and should be understood with reference to the text and drawings that follow.

Figure 1:
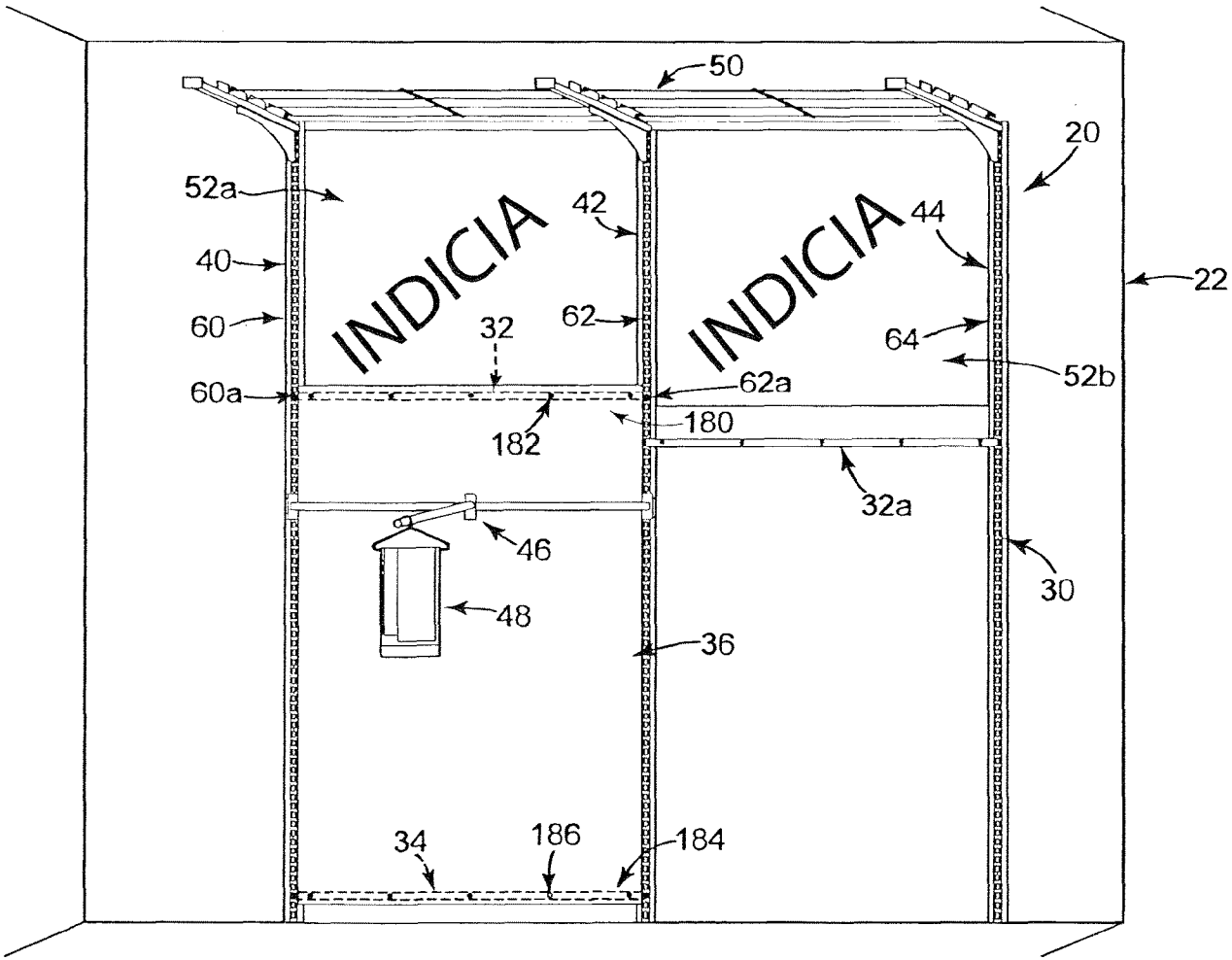
FIG. 1 is perspective view of a display system, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

FIG. 1 shows a display system 20 secured to a support structure 22, such as a wall, according to some embodiments. The display system 20 includes a base assembly 30, a top hardware bar 32, a bottom hardware bar 34, and a backer piece 36. The top and bottom hardware bars 32, 34 are largely obscured by the backer piece 36 in FIG. 1, and thus are represented by dotted lines in FIG. 1. In order to provide additional understanding, a second top hardware bar 32*a* is shown in solid lines to the right of the top hardware bar 32 without an associated backer piece. In general terms, and as will be subsequently described, the backer piece 36 is secured to the top and bottom hardware bars 32, 34. The top hardware bar 32, in turn, is releasably secured to the base assembly 30 in order to hang the backer piece 36 from the base assembly 30.

Using bolts or other fasteners, the base assembly 30, also described as a support assembly, is optionally secured to the support structure 22, such as a wall or other stationary base fixture. The support structure 22 is optionally in a retail environment, such as a store, although other environments, such as storage or home environments, are also contemplated. The base assembly 30 includes a first upright 40, a second upright 42, a third upright 44, one or more product fixtures 46 maintaining one or more products 48, a top fixture system 50, and header signs 52*a*, 52*b*.

The first upright 40, also described as a vertical standard or a standard, is substantially elongate in shape and is optionally formed as a hollow, tubular bar having a first plurality of holes 60 formed along a length of the first upright 40. The first upright 40 is formed of metal, plastic, or other suitable material and is optionally substantially square in cross-section, substantially U-shaped in cross-section, or is otherwise suitably shaped. Each of the first plurality of holes 60 is optionally substantially rectangular, square, oval, or circular, for example. As will be described greater detail, each of the first plurality of holes 60 defines an attachment site, or attachment point, for the top hardware bar 32.

The second and third uprights 42, 44 are optionally substantially similar to the first upright 40, and as such can be described cumulatively with reference to the first upright 40. The second and third uprights 42, 44 accordingly have a second plurality of holes 62 and a third plurality of holes 64, respectively, laterally offset and generally corresponding in height to the first plurality of holes 60.

The one or more product fixtures 46 are adapted to be releasably secured to the first and second uprights 40, 42. The one or more products 48 are selected from a variety of items, including merchandise on display, such as clothing on hangers—pants, for example.

The top fixture system 50 is adapted to be releasably secured to the first, second, and third uprights 40, 42, 44. The top fixture system 50 provides attachment sites for hanging visual displays (not shown), for example, such as posters, signs, or other objects. In particular, wires or other fasteners are optionally secured to the top fixture system to hang a particular visual display.

The header signs 52*a*, 52*b* include indicia, such as graphics, which, in combination with the backer piece 36 optionally present a combined "theme." For example, the header signs 52*a*, 52*b* include information relating to swimwear and the backer piece is optionally a bamboo screen material conveying a combined swimwear and island or tropical vacation theme.

Construction of the base assembly 30 includes securing each of the first, second, and third uprights 40, 42, 44 in a substantially vertical orientation. The uprights 40, 42, 44 are optionally secured to a wall (not shown) or other appropriate support as desired. The uprights 40, 42, 44 are laterally spaced from one another and are substantially parallel. As alluded to above, the first, second, and third pluralities of holes 60, 62, 64 are laterally aligned, corresponding in height to define corresponding lateral sets of attachment sites. The product fixture 46 maintaining the products 48 is secured between the first and second uprights 40, 42 at one or more lateral sets of attachment points. In turn, the top fixture system 50 is releasably secured to the first, second, and third uprights 40, 42, 44. The header sign 52*a* is secured between the first and second uprights 40, 42 and the header sign 52*b* is secured between the second and third uprights 42, 44.

Figure 2:
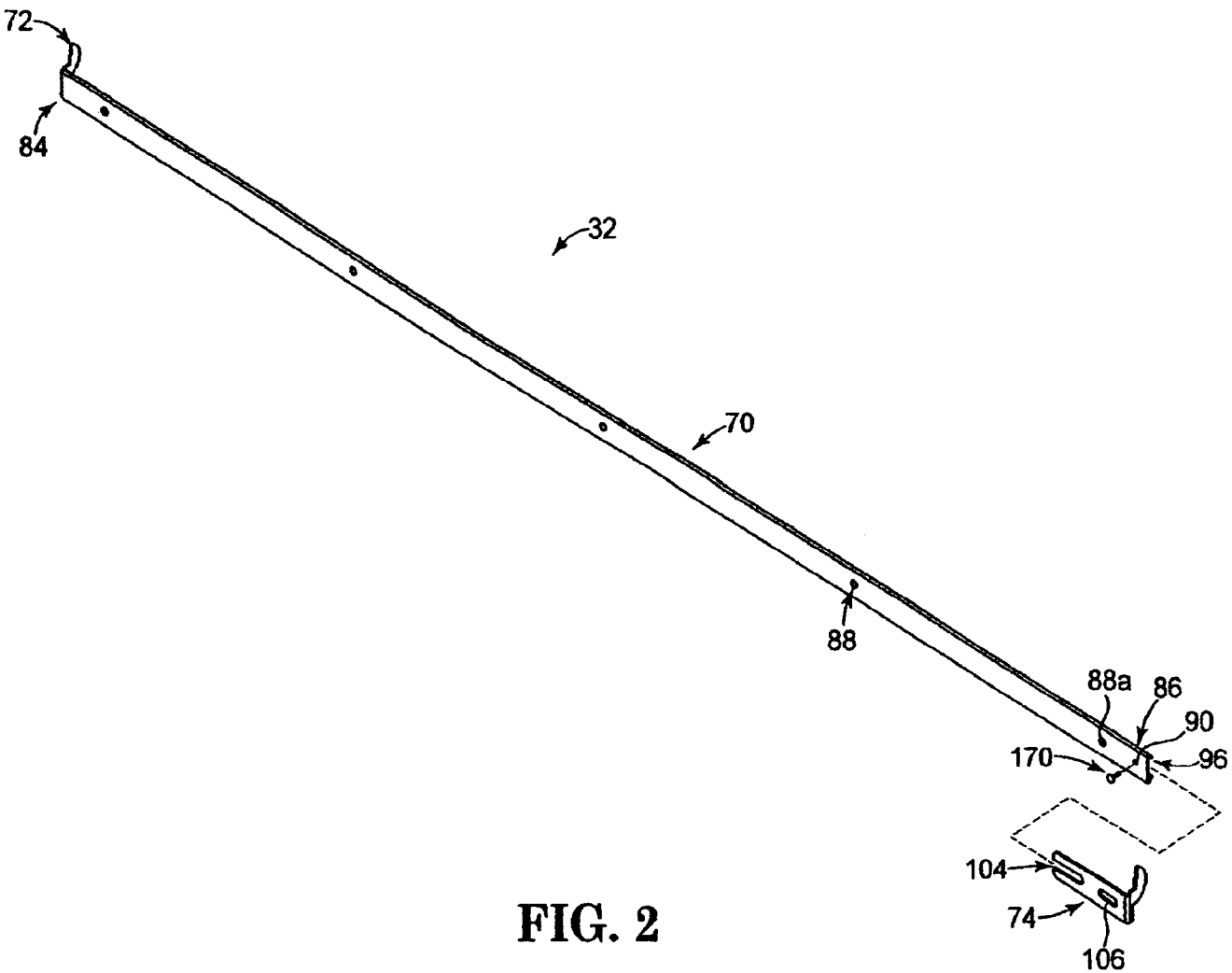
FIG. 2 is a perspective view of a top hardware bar of the display system of FIG. 1, according to some embodiments.

FIG. 2 shows the top hardware bar 32, also described as an upper support member or top bar, from a perspective view and in a disassembled state. The top hardware bar 32 includes a body 70, a first bracket 72, and a second bracket 74. As will be described in greater detail below, the first bracket 72 is optionally rigidly secured to the body 70, for example being substantially continuously formed with the body 70, welded to the body 70, or otherwise secured relative to the body 70. In turn, the second bracket 74 is telescopically adjustable relative to the body 70 to facilitate use of the top hardware bar 32 with sets of attachment points having different lateral offsets. The top hardware bar 32 is optionally formed of metal, plastic, or other suitable material.

Figure 3:
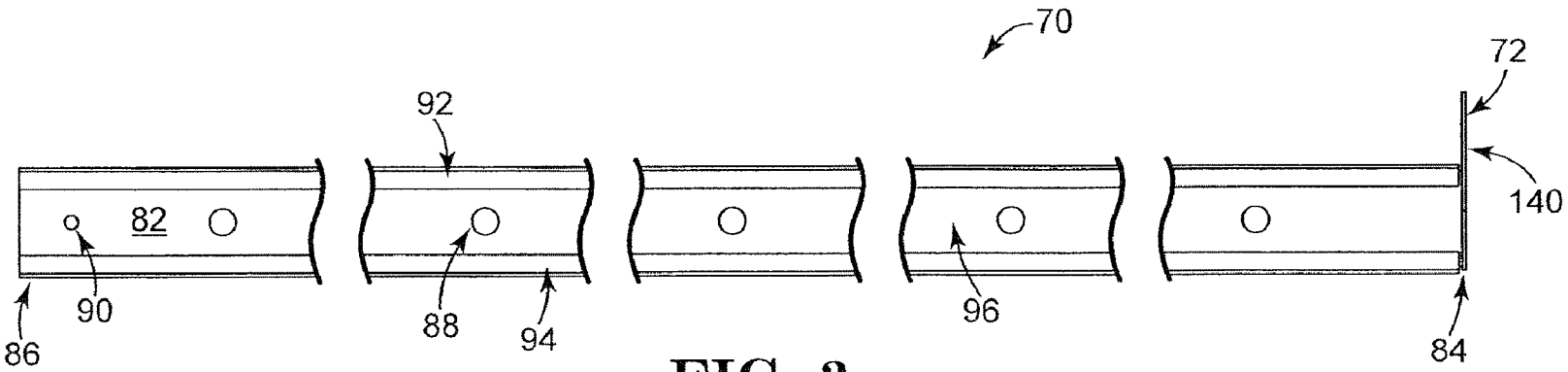
FIG. 3 is a back, broken view of a body of the top hardware bar of FIG. 2, according to some embodiments.
Figure 4:
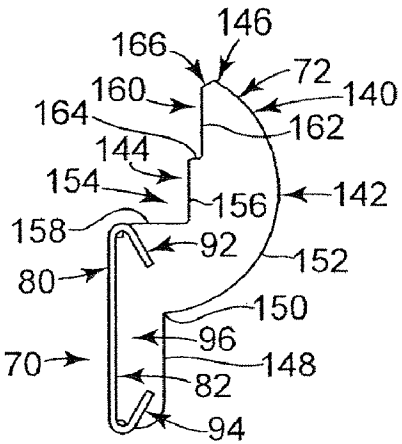
FIG. 4 is a right end view of the body of FIG. 3, according to some embodiments.

FIG. 3 shows the body 70 from a back, broken view and FIG. 4 shows the body 70 from a right end view. With reference to FIGS. 3 and 4, the body 70 defines a front face 80, a back face 82, a first end 84, a second end 86, a plurality of fastener holes 88, and a pin hole 90, and forms a top lip 92 and a bottom lip 94. The top and bottom lips 92, 94 are folded backward from the front face 80 toward the back face 82. In particular, the body 70 is optionally substantially rectangular in front profile and substantially C-shaped in transverse cross-section. The top and bottom lips 92, 94 together with the back face 82, define a channel 96 extending along at least a portion of the body 70.

The plurality of fastener holes 88 are disposed lengthwise along the body 70. Each of the fastener holes 88 is adapted to receive fasteners, such as plastic clips sold under the trade name "CANOE clips" (available from ITW Fastex of Des Plaines, Ill.), plastic bolts, rivets, wires or other fasteners adapted for releasably or non-releasably securing the backer piece 36 (FIG. 1) to the body 70. In turn, the pin hole 90 resides proximate the second end 86 of the body 70 and is adapted to receive a rivet or other pin, which, as will be described in greater detail below, assists in adjustably securing the second bracket 74 (FIGS. 5 and 6) to the body 70. In other words, the body 70 provides part of the means for releasably attaching the top hardware bar 32 to the backer piece 36.

The body 70 is about 47.406 inches long, about 1.031 inches tall, and about 0.281 inches thick overall (including extension of the lips 92, 94), although other dimensions are contemplated. The top and bottom lips 92, 94 each extend at about 30 degrees relative to the back face 82, although other angles are contemplated. Each of the plurality of fastener holes 88 is about 0.25 inches in diameter and is spaced from an adjacent hole 88 by about 10.875 inches, although other dimensions are contemplated.

Figure 5:
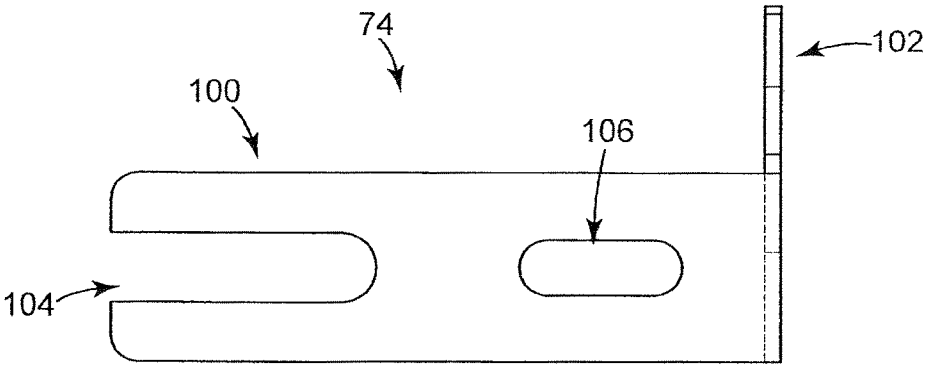
FIG. 5 is a front view of a bracket of the top hardware bar of FIG. 2, according to some embodiments.
Figure 6:
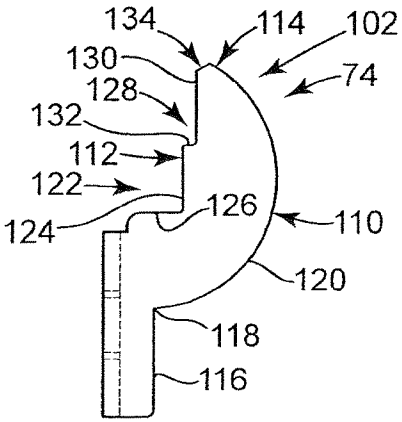
FIG. 6 is a right end view of the bracket of FIG. 5, according to some embodiments.

FIG. 5 shows the second bracket 74 from a front view and FIG. 6 shows the second bracket 74 from a right end view. With reference to FIGS. 5 and 6, the second bracket 74 includes an insert arm 100, also described as a slide arm or slide portion, and a tab 102. The insert arm 100 is formed as a thin, elongate piece sized and shaped for insertion into the channel 96 of the body 70. The insert arm 100 defines a cutout 104 and a slot 106. The cutout 104 is adapted to allow the second bracket 74 to be slid in and out of the body 70 without interfering, i.e., blocking, one of the plurality of fastener holes 88. As will be described in greater detail below, the slot 106 is adapted to limit sliding of the second bracket 74 relative to the body 70. In particular, the second bracket 74 provides part of the means for releasably securing the top hardware bar 32 to the second upright 42, as well as part of the means for adjusting an overall length of the top hardware bar 32.

The tab 102, also described as a tooth or tooth portion, is a thin piece protruding orthogonally from the insert arm 100. The tab 102 is optionally formed continuously with the insert arm 100 or is otherwise secured thereto. The tab 102 defines a back edge 110, a front edge 112, and a distal tip 114. The back edge 110 includes a straight, substantially vertical portion 116 extending to a corner 118 where the back edge 110 transitions to a semi-circular portion 120, also described as an arcuate portion or edge. The front edge 112 includes a first step 122, or L-shaped edge, defining a front 124 and a tread 126, a second step 128, or L-shaped edge, defining a front 130 and a tread 132, and a taper 134 at the distal tip 114. As will be described in greater detail, the tab 102 is adapted to be inserted, distal tip 114 first, into one of the pluralities of holes 60, 62, 64 associated with the uprights 40, 42, 44 and then pivoted downwardly to releasably secure the second bracket 74 to one of the uprights 40, 42, 44.

The insert arm 100 is about 3 inches long, the slot 106 is about 0.750 inches long (defining a travel limit of about 0.750 inches for the second bracket 74), the tab 102 has an overall height of about 1.625 inches, and the semi-circular portion 120 has a radius of curvature of about 0.594 inches, although other dimensions are contemplated.

Returning to FIGS. 3 and 4, the first bracket 72 includes a tab 140 that is optionally substantially similar to the tab 102 (FIG. 5) of the second bracket 74. As such, the first bracket 72 also optionally defines a back edge 142, a front edge 144, and a distal tip 146. The back edge 142 includes a straight, substantially vertical portion 148 extending to a corner 150 where the back edge 142 transitions to a semi-circular portion 152. The front edge 144 includes a first step 154 defining a front 156 and a tread 158, a second step 160 defining a front 162 and a tread 164, and a taper 166 at the distal tip 146. The first bracket 72 is directly attached to the first end 84 of the body 70 or is otherwise rigidly secured thereto. It should also be understood that it is also contemplated that the first bracket 72 is additionally or alternatively adjustably secured to the body 70 similarly to the second bracket 74 according to some embodiments. As will be described in greater detail, the first bracket provides part of the means for releasably securing the top hardware bar 32 to one of the attachment sites of the first upright 40.

Similarly to the second bracket 74, the tab 140 of the first bracket 72 has an overall height of about 1.125 inches and the semi-circular portion 152 has a radius of curvature of about 0.594 inches, although other dimensions are contemplated.

Returning to FIG. 2, assembly of the top hardware bar 32 includes sliding the second bracket 74 into the channel 96 of the body 70 at the second end 86. A pin 170, such as a rivet, is fastened in the pin hole 90 with the pin 170 extending through the slot 106 to define a pin-and-slot mechanism, or pin-and-slot relationship, limiting the inward and outward travel of the second bracket 74 within the channel 96. As the second bracket 74 is slid inwardly and outwardly, the cutout 104 generally overlaps a first one of the plurality of fastener holes 88*a*. In other words, the cutout 104 helps to ensure that the fastener hole 88*a* is not blocked by the second bracket 74 as it is adjusted between the inner and outer limits. In some embodiments, the second bracket 74 is adjustable through a travel of about 1.5 inches, although other amounts of travel are also contemplated.

Figure 7:
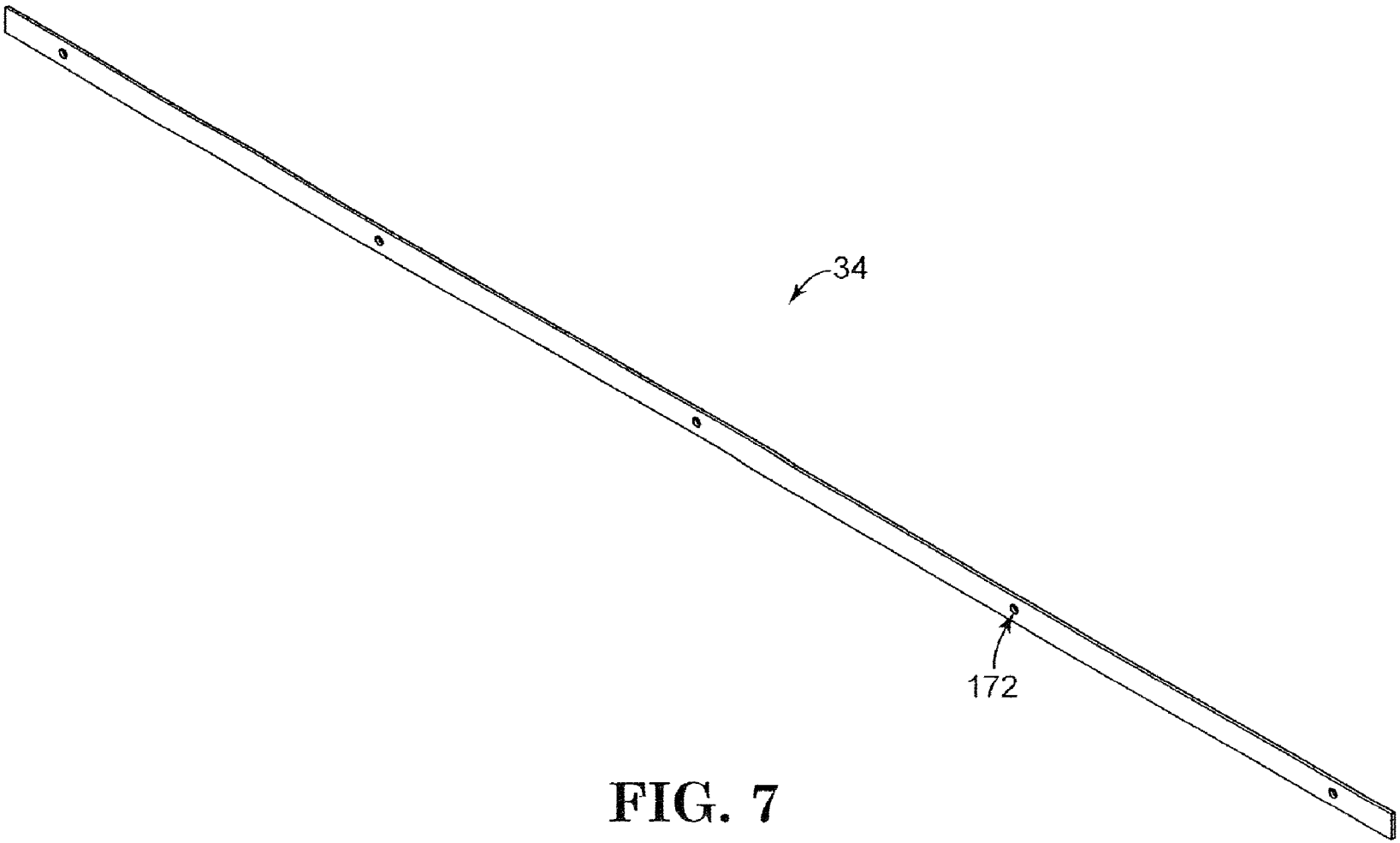
FIG. 7 is a perspective view of a bottom hardware bar of the display system of FIG. 1, according to some embodiments.

FIG. 7 shows the bottom hardware bar 34, also described as a lower support member or bottom bar, from a perspective view. The bottom hardware bar 34 is substantially elongate and defines a substantially rectangular transverse cross-section, although other shapes are contemplated. The bottom hardware bar 34 has a plurality of fastener holes 172 formed along a length of the bottom hardware bar 34. As will be described in greater detail below, the fastener holes 172 optionally provide part of the means for releasably attaching the bottom hardware bar 34 to the backer piece 36. The plurality of fastener holes 172 are adapted to receive a fastener, such as a CANOE clip, for securing the bottom hardware bar 34 to the backer 36 (FIG. 1), as will be described in greater detail. The bottom hardware bar 34 is optionally formed of metal, plastic, or other suitable material.

The bottom hardware bar 34 is about 47.5 inches long and about 0.750 inches tall, although other dimensions are contemplated. Each of the plurality of fastener holes 172 is about 0.25 inches in diameter and is spaced from an adjacent hole 172 by about 10.875 inches, although other dimensions are contemplated.

Returning to FIG. 1, the backer piece 36, also described as a backer material or backer piece, is sheet-like or otherwise defines a panel or sheet form, although other forms are contemplated. The backer piece 36 defines a top portion 180, also described as an upper region or top edge region, having a plurality of fastener holes 182, or openings, and a bottom portion 184, also described as a lower region or bottom edge region, having a plurality of fastener holes 186, or openings. The backer piece 36 is substantially rectangular in the front profile, although other shapes are contemplated. The backer piece 36 is optionally formed of plastic sheet material, paper sheet material, wood material, such as bamboo screen material, pegboard material, as well as other materials. It should be understood that the sheet-like pieces, panels, and sheet forms are not limited to substantially flat-faced objects unless specified as such.

Assembly of the top hardware bar 32 to the backer piece 36 includes placing the top hardware bar 32 behind the backer piece 36 and aligning the plurality of fastener holes 88 (FIG. 2) of the top hardware bar 32 to the plurality of fastener holes 182 in the top portion 180 of the backer piece 36 with the front face 80 against the backer piece 36. A plurality of fasteners (not shown) such as push-in clips, CANOE clips, plastic screws, or others are then inserted through the corresponding sets of fasteners holes 88, 182 to releasably secure the top hardware bar 32 to the backer piece 36. Additionally, or alternatively, the backer piece 36 optionally includes a fold or loop of material (not shown) for receiving the body 70 of the top hardware bar 32.

The bottom hardware bar 34 is similarly fastened to the backer piece 36. In particular, assembly includes placing the bottom hardware bar 34 behind the backer piece 36 and aligning the plurality of fastener holes 172 (FIG. 7) of the bottom hardware bar 34 to the plurality of fastener holes 186 in the bottom portion 184 of the backer piece 36. A plurality of fasteners (not shown) such as push-in clips, CANOE clips, plastic screws, or others are then inserted through the corresponding sets of fasteners holes 172, 184 to releasably secure the bottom hardware bar 34 to the backer piece 36. Additionally, or alternatively, the backer piece 36 optionally includes a fold or loop of material (not shown) for receiving the bottom hardware bar 34.

Figure 8:
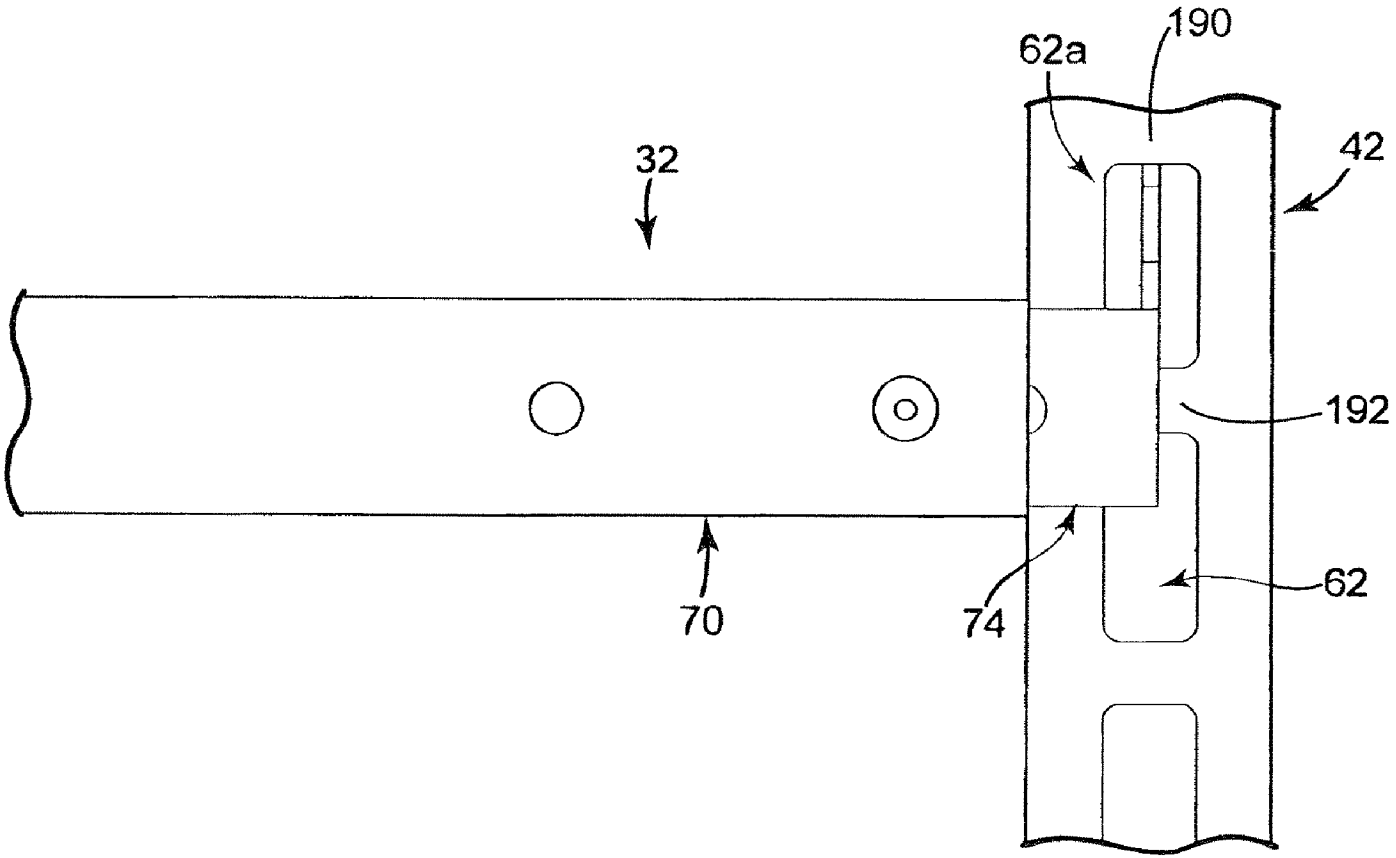
FIG. 8 is a front view of the top hardware bar of FIG. 2 assembled to an upright of the display system of FIG. 1, according to some embodiments.
Figure 9:
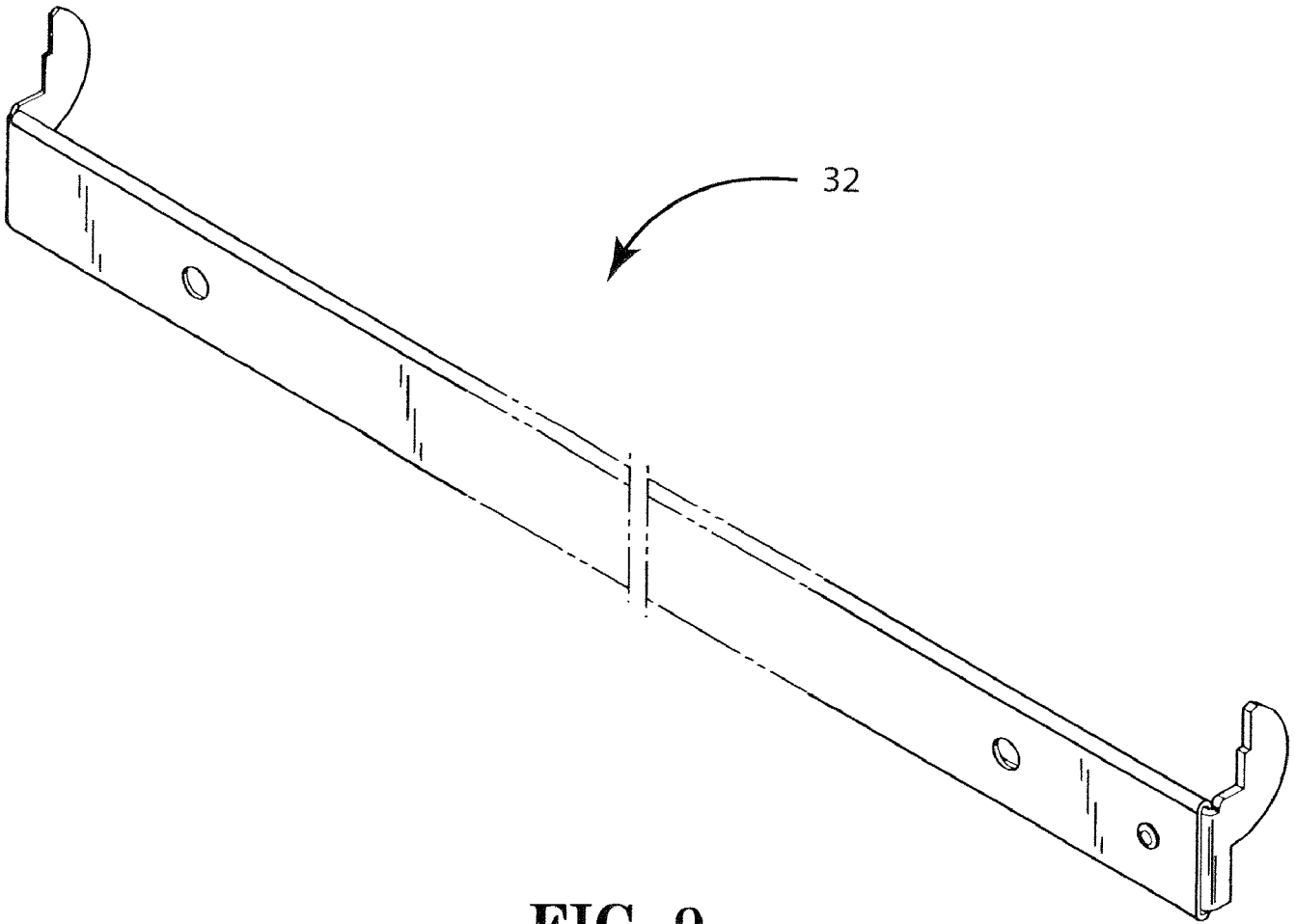
FIG. 9 is a perspective view of a top hardware bar, according to some embodiments.
Figure 10:
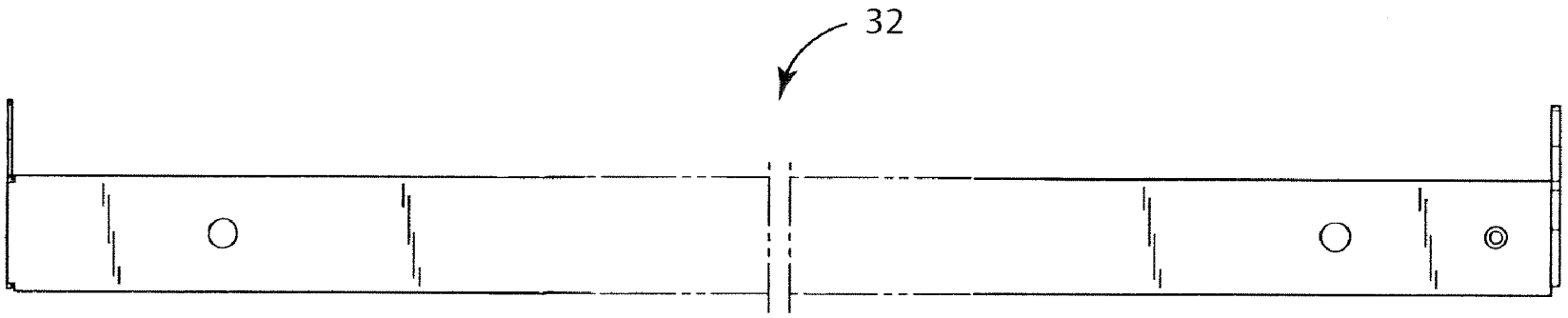
FIG. 10 is a front view of the top hardware bar of FIG. 1, according to some embodiments.
Figure 11:
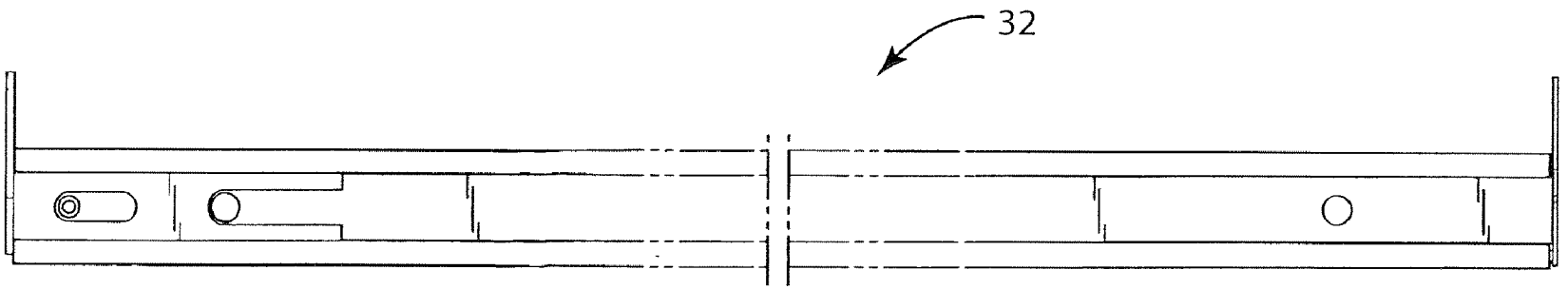
FIG. 11 is a back view of the top hardware bar of FIG. 1, according to some embodiments.
Figure 12:
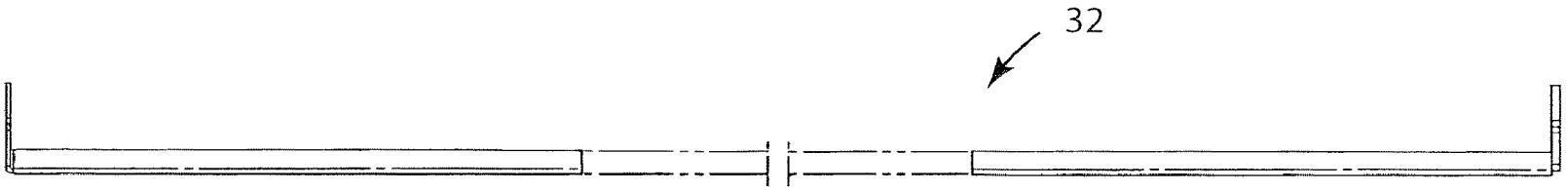
FIG. 12 is a top view of the top hardware bar of FIG. 1, according to some embodiments.
Figure 13:
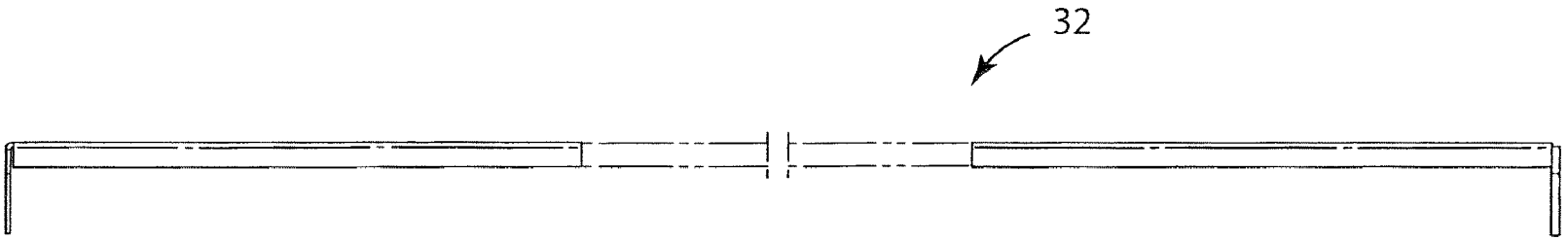
FIG. 13 is a bottom view of the top hardware bar of FIG. 1, according to some embodiments.
Figure 14:
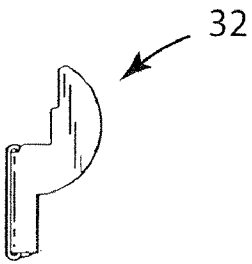
FIG. 14 is a right end view of the top hardware bar of FIG. 1, according to some embodiments.
Figure 15:
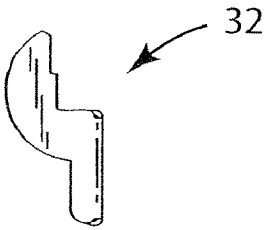
FIG. 15 is a left end view of the top hardware bar of FIG. 1, according to some embodiments.

The top hardware bar 32 is then optionally assembled to the base assembly 30 using the first and second brackets 72, 74. FIG. 8 is a front view of a portion of the top hardware bar 32 assembled to a target hole 62*a* of the plurality of holes 62 of the second upright 42. For ease of understanding, the backer piece 36 is not shown in FIG. 8, although it should be understood that the top hardware bar 32 is optionally assembled to the base assembly 30 before or after assembly of the backer piece 36 to the top hardware bar 32. As shown in FIG. 8, the target hole 62*a* is defined by a top edge of material 190 and a bottom edge of material 192 forming the second upright 42.

With reference between FIGS. 1, 6, and 8, assembly of the top hardware bar 32 to the base assembly 30 includes adjusting the length of the top hardware bar 32 by sliding the second bracket 74 to a desired position. In particular, the length of the top hardware bar 32 is adjusted such that the first and second brackets 72, 74 line up with a set of target holes 60*a*, 62*a* of the pluralities of holes 60, 62 of the first and second uprights 40, 42, respectively. In this manner, the top hardware bar 32 allows for releasable fixation at a variety of upright spacings and also allows for some "slop" or deviation in the spacing between the first and second uprights 40, 42.

In particular, the method of assembling includes inserting the distal tip 114 of the second bracket 74 into the target hole 62*a* of the plurality of holes 62. The taper 134 optionally facilitates smooth insertion of the distal tip 114 into the target hole 62*a*. The distal tip 146 of the first bracket 72 (FIG. 4) is similarly inserted into the target hole 60*a*. Following insertion, the top hardware bar 32, including the first and second brackets 72, 74 is pivoted downwardly toward the first and second uprights 40, 42. As the second bracket 74 is pivoted, the semi-circular portion 120 of the back edge 110 cams against the bottom edge of material 192 until the bottom edge of material 192 is received in the corner 118. The camming action provided by the back edge 110 helps facilitate smooth pivoting of the second bracket 74 during assembly into the target hole 62*a*.

During the camming action, the front edge 112 is pivoted forward until it contacts the top edge of material 190 from within the target hole 62*a*. In particular, the front 130 of the second step 128 contacts the top edge of material 190 and optionally rests on the tread 132, which, in combination with the corner 118 acts to releasably retain the second bracket 74 in the target hole 62*a*. The first bracket 72 is similarly inserted into and pivoted within a target hole 60*a* (FIG. 1) of the first upright 40 to releasably retain the first bracket 72 to attachment site defined by the target hole 60*a* of the first upright 40.

Where substantially the target holes 60*a*, 62*a* are substantially smaller than shown, the first steps 122, 154 are instead used to releasably fasten the first and second brackets 72, 74 to the first and second uprights 40, 42. In particular, the front 124 of the first step 122 contacts the top edge of material 190 and optionally rests on the tread 126, which, in combination with the corner 118 acts to releasably retain the second bracket 74 in the smaller target hole 62*a*. The first bracket 72 is similarly inserted into and pivoted within a smaller target hole 60*a* to releasably retain the first bracket 72 to the attachment site defined by the target hole 60*a* of the first upright 40. Thus, it should be understood that the top hardware bar 32 can be used with target holes of different sizes as desired.

With the assembly and arrangement described above, each of the first and second brackets 72, 74 provides means for releasably securing the top hardware bar 32 to the base assembly 30. From the preceding description, it should be understood that the weight of the backer piece 36, as well as the weight of the bottom hardware bar 34, optionally assists with retaining the first and second brackets 72, 74 in the downwardly pivoted, secure position. When release of the first and second brackets 72, 74 is desired, the top hardware bar 32 is pivoted upwardly with the body 70 moving outwardly and away from the first and second uprights 40, 42.

As alluded to above, a method of displaying merchandise to an observer in an environment, such as a retail environment, includes securing the first upright 40 in a substantially vertical orientation to the support structure 22 and securing the second upright 42 in a substantially vertical orientation to the support structure 22. The product fixture 46 is releasably secured to the first and second uprights 40, 42 and maintains the products 48, clothing (also referred to as "softlines") for example, such that the products hang in front of the support structure 22 off of a floor of a retail location, according to some embodiments.

The top hardware bar 32 is releasably attached to the top portion 180 of the backer piece 36, for example, by aligning the pluralities of fastener holes 88, 182 and utilizing fasteners, such as CANOE clips, as previously described. The bottom hardware bar 34 is releasably secured to the bottom portion 184 of the backer material 36, for example, by aligning the pluralities of fastener holes 172, 186 and utilizing fasteners, such as CANOE clips, as previously described.

The overall length of the top hardware bar 32 is adjusted as desired to correspond to the lateral distance between the first and second target holes 60*a*, 62*a* of the first and second uprights 40, 42, respectively. For example, the second bracket 74 is optionally telescoped within the channel 96 to adjust the top hardware bar 32 to the desired length.

The top hardware bar 32 (with the backer piece 36 when previously assembled thereto) is slid behind the one or more product fixtures 46 and the one or more products 48. Each of the first and second brackets 72, 74 is secured to a lateral set of attachment sites corresponding to the first and second target holes 60*a*, 62*a* by inserting the tabs 102, 140 into the target holes 60*a*, 62*a*, respectively and pivoting the top hardware bar 32 downwardly and toward the base assembly 30 and support structure 22. This releasably secures the backer piece 36 in a substantially vertical orientation from the base assembly 30 and behind the one or more hanging products 48. In turn, the bottom hardware bar 34 exerts a tension on the backer piece 36 to help maintain the backer piece 36 in a proper orientation, to remove unwanted wrinkles, to reduce swaying or unwanted movement, or to provide other functionality.

For reference, the top hardware bar 32, bottom hardware bar 34, backer piece 36, instructions, and appropriate fasteners, such as CANOE clips, are optionally provided to a retail location as a kit of parts. If desired, a plurality of different backer pieces 36 are provided with the kit of parts.

Various advantages are optionally accomplished through use of the display system 20. For example, the top hardware bar 32, as well as the backer piece 36, is optionally assembled to the base assembly 30 after the one or more product fixtures 46 and products 48 have been assembled to base assembly 30. This facilitates interchanging backer pieces as desired and allows flexibility in the manner in which a product display is assembled. Furthermore, the backer piece 36 and header signs 52*a*, 52*b* are readily changed, mixed-and-matched, adjusted, or otherwise optimized to provide a pleasing display to an observer.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A method of displaying comprising:

securing a first standard in a substantially upright position;

securing a second standard in a substantially upright position;

releasably attaching a top bar to a top region of a backer material, the backer material being in a sheet format, the top bar including a first bracket and a second bracket at opposite ends of the top bar, and the top bar and the top region of the backer material having corresponding holes for releasably attaching the backer material to the top bar;

adjusting an overall length of the top bar to correspond to a distance between a first attachment site defined by the first standard and a second attachment site defined by the second standard;

releasably securing the top bar to the first and second attachment sites to hang the backer material in a substantially upright position from the first and second standards, the backer material extending between the first and second uprights without extending beyond a width between the first and second attachment sites, wherein the second bracket includes a slide portion and a tooth portion arranged substantially perpendicular to the slide portion, the slide portion including a slot for receiving a pin to limit adjustment of the slide portion relative to a body of the top bar; and defining with the tooth portion an arcuate outer edge and a stepped inner edge that is releasably securable to the second attachment site of the second standard.

2. The method of claim 1, further comprising:

securing each of the first and second standards to a wall; and maintaining a plurality of products in front of the wall and in front of the backer material with the first and second standards.

3. The method of claim 1, wherein releasably securing the top bar to the first and second attachment sites of the first and second standards includes pivoting the tooth portion of the second bracket into a hole in the second standard at the second attachment site.

4. The method of claim 1, performed in a retail environment.

5. The method of claim 1, wherein adjusting an overall length of the top bar includes telescoping the slide portion of the second bracket into the body of the top bar.

6. The method of claim 1, further comprising telescopically receiving the slide portion of the second bracket in the body of the top bar.

7. The method of claim 1, further comprising securing a bottom bar to a bottom region of the backer material to tension the backer material.

8. The method of claim 1, wherein the body of the top bar includes a top lip and a bottom lip, the method further comprising:

folding the top and bottom lips backward to define a channel, and adjustably securing the second bracket to the body of the top hardware bar by inserting a pin into the slot of the slide portion.

9. The method of claim 1, further comprising non-adjustably securing the first bracket of the top bar to the body of the top bar.

10. The method of claim 1, further comprising securing a bottom bar to a bottom portion of the backer material for applying tension to the backer material.

11. The method of claim 1, further comprising hanging a plurality of products in front of the backer material.

12. A method of assembling a display system comprising:

securing a first upright in a substantially vertical orientation, the first upright being substantially elongate and having a first plurality of slots, the first plurality of slots being aligned in a column on one side of the first upright;

securing a second upright in an adjacent position to the first upright and in a substantially vertical orientation, the second upright being substantially elongate and having a second plurality of slots, the second plurality of slots being aligned in a column on one side of the second upright;

attaching a top hardware bar including:

a body that is elongate and defines a first end, a second end opposite the first end, a front face, a channel, and a plurality of holes disposed lengthwise along the body, a first bracket secured to the first end of the body and releasably securable in the first plurality of slots of the first upright, and a second bracket adjustably secured within the channel at the second end of the body and releasably securable in the second plurality of slots of the second upright;

securing a backer piece directly to the body front face of the top hardware bar along a top portion of the backer piece such that the backer piece hangs from the top hardware bar and extends between the first and second uprights without overlapping the first and second plurality of slots; and securing at least one product fixture between the first and second uprights in corresponding ones of the slots of the first and second uprights, wherein the product fixture is disposed on a side of the backer piece opposite from the hardware bar and supports a product for display, wherein the body of the top hardware bar includes a top lip and a bottom lip, the method comprising folding the top and bottom lips backward from the front face to define the channel, and wherein the second bracket includes an insert arm and a tab arranged substantially perpendicular to the insert arm, the method comprising providing the insert arm with a slot for receiving a pin to adjustably secure the second bracket to the body of the top hardware bar, and defining with the tab an arcuate outer edge and a stepped inner edge that is releasably securable within one of the plurality of slots of the second upright.

13. The method of claim 12, further comprising non-adjustably securing the first bracket of the top hardware bar to the body of the top hardware bar.

14. The method of claim 12, further comprising securing a bottom hardware bar to the bottom portion of the backer piece for applying tension to the backer piece.

15. The method of claim 12, further comprising hanging a plurality of the products on the product fixture and in front of the backer piece.

16. The method of claim 12, further comprising:

securing each of the first and second uprights to a wall; and maintaining a plurality of the products on the product fixture and in front of the wall and in front of the backer material with the first and second uprights.

* * * * *